United States Patent [19]

Lehrman

[11] Patent Number: 4,751,786

[45] Date of Patent: Jun. 21, 1988

[54] IRON SOLE PLATE CLEANING ARTICLE

[76] Inventor: David Lehrman, 207 Barclay Cir., Cheltenham, Pa. 19012

[21] Appl. No.: 923,949

[22] Filed: Oct. 28, 1986

[51] Int. Cl.[4] ..... D06F 83/00

[52] U.S. Cl. ..... 38/140; 428/224; 428/252; 428/253; 428/248; 428/284

[58] Field of Search ..... 428/224, 253, 248, 232, 428/233, 252, 284; 38/140

[56] References Cited

U.S. PATENT DOCUMENTS

| | | | |
|---|---|---|---|
| 2,544,798 | 3/1951 | Lippmann | 428/233 |
| 3,049,826 | 8/1962 | Goldsmith | 139/420 R |
| 3,911,603 | 10/1975 | Lehrman | 38/140 |
| 4,043,062 | 8/1977 | Lehrman | 38/140 |
| 4,369,218 | 1/1983 | Mazere | 428/233 |
| 4,484,400 | 11/1984 | Lehrman | 38/140 |
| 4,499,134 | 2/1985 | Whitely et al. | 428/233 |
| 4,603,494 | 8/1986 | Lehrman | 38/140 |

*Primary Examiner*—James J. Bell

*Attorney, Agent, or Firm*—Seidel, Gonda, Goldhammer & Abbott

[57] ABSTRACT

The present invention is directed to an article for cleaning the sole plate of an iron. The article is preferably affixed to the portion of an ironing board cover which is adjacent the rectangular end. The article includes a raised abrasive surface, a lower abrasive surface and an absorbent surface. The abrasive surface is preferably a woven material. The weave of the abrasive surface preferably is more abrasive in one direction when the iron is stroked across the weave.

13 Claims, 1 Drawing Sheet

IRON SOLE PLATE CLEANING ARTICLE

SCOPE OF THE INVENTION

The present invention is directed to an iron sole plate cleaning article which is affixed to an ironing board cover preferably in an area of the cover which is removed from the general ironing work area.

BACKGROUND OF THE INVENTION

During the ironing process, there is a residual deposit or "build up" of matter on the sole plate of the iron which adversely affects the smooth uninterrupted gliding and mobility of the iron during use. Additionally, this build up inhibits the emission of steam from the steam vents located through the sole plate.

This undesirable deposit is sporadically transferred to the article being ironed. This causes permanent or temporary discoloration or staining of the article. The partial closing of steam vents inhibits the uniform flow and distribution of steam which is essential for efficient ironing and maximum effectiveness of the iron. Furthermore, this cumulative and uneven deposit significantly affects the speed of ironing because the coefficient of friction of the "build up" is greater than that of the sole plate. The deposits decrease the thermal effeciency of the sole plate because greater energy is required to heat the surface of the sole plate. Finally, the build up reduces the quality, appearance and level of finish of the ironed laundry.

The deposit is formed from starch adhered to the iron sole plate, melted synthetic fabric, a mineral content of water, materials used for coating or impregnating the ironing board cover or laundry, and scorch transfers.

SUMMARY OF THE INVENTION

The present invention is directed to an article for use in conjunction with an ironing board cover. The article comprises an abrasive means which is affixed to the ironing board cover, absorbent means which is affixed to the ironing board cover, and is juxtaposed to said abrasive means.

Additionally, it may include a raised abrasive portion and a lower abrasive portion. The aborbent portion may be raised.

DETAILED DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
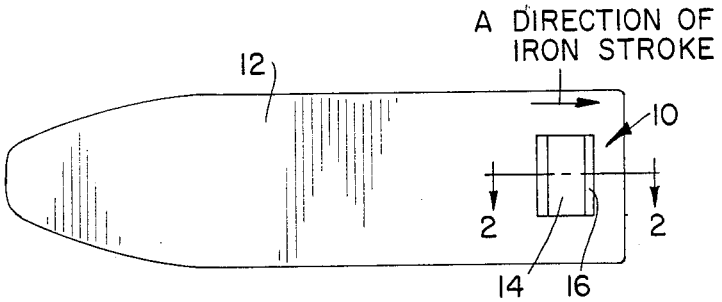
FIG. 1 is a plan view of an ironing board cover including a preferred embodiment of the present invention affixed thereto.

Referring to the drawings wherein like number represent like elements, there is shown in FIG. 1 a preferred embodiment of the present invention generally designated 10.

Article 10 is for cleaning the sole plate of an iron article. The article 10 is fixed in any conventional manner, proximal the rectangular end of a tapered ironing board cover 12. The ironing board cover 12 is well-known to those skilled in the art and may comprise any fabric or material of construction having or not having various coatings or impregnations. The ironing board cover 12 is not limiting on this invention.

The article 10 generally comprises an abrasive surface 14 and an absorbent surface 16 which is juxtaposed to the abrasive surface 14.

The abrasive surface 14 is preferably made from a strip of a knitted extruded monofilament nylon 66 fiber. Of course, the present inention is not limited to that specific material as is set forth below. The strip is preferably woven such that the abrasive resistance of the weave is greater in one direction than in another. For example, the abrasive resistance of the material is greater in the direction of arrow A in FIG. 1. Such knitting weaves are well-known to those skilled in the art. Alternately, the abrasive surface may be made of other materials such as polyester or coated fiberfill, coated polyurethane foam, coated felt or textiles, coated woven or non-woven materials of any pure or blended fiber content. Additionally, the abrasive surface 14 may comprise a gritty coated surface. When choosing the abrasive material, it is important to consider that many modern irons have a non-stick surfaced adhered to the sole plate. Such non-stick materials may include SilverStone (TM) or Teflon (TM) products of Du Pont. Accordingly, if irons having non-stick surfaces come in contact with the article 10 made from such abrasive materials as steel wool, emery paper, sandpaper, they would be less preferred because those materials would scrape off the non-stick coating.

The absorbent surface 16 is preferably made from 100 percent cotton or a blend of material which is predominantly cotton. Of course, any other absorbent material may be used. Additionally, the absorbent surface may be chemically treated so that the removal of "build-up" is facilitated. The chemicals used can be baking soda and water.

Figure 2:
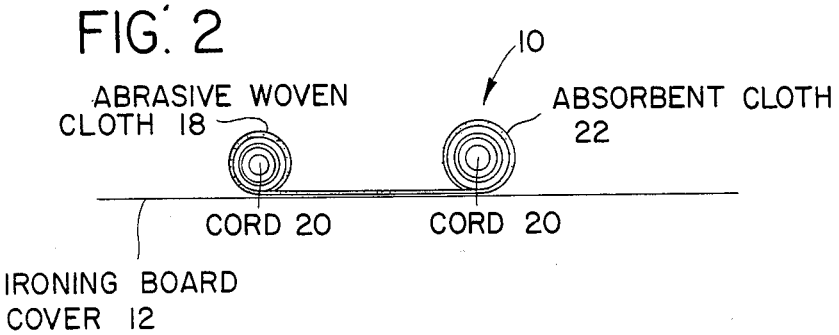
FIG. 2 is a sectional view of the preferred embodiment taken along lines 2—2.

Referring to FIGS. 1 and 2, a preferred embodiment of the present invention is illustrated. The abrasive cloth 18 is generally scroll shaped in cross section and has a roll at each lateral edge portion. A cord 20 is located at the center of each roll. The cord 20 is preferably any material having a diameter of about $\frac{1}{8}$ to $\frac{1}{4}$ of an inch. For example, the cord 20 can be a hem or fiber rope. The cord 20 provides a raised surface for the leading and trailing edges of the article 10. The importance of these raised edges will be discussed in greater detail below.

Along the trailing edge of the article, an absorbent cloth 22 is wrapped around the affixed to the abrasive material 18 and cord 20.

In operation, an iron having a sole plate with build up is stroked across the article 10 in the direction shown in FIG. 1 by arrow A. The sole plate strikes the leading raised edge of the abrasive surface 14. The raised leading edge has a higher abrasive affect because of the increased pressure between the sole plate and abrasive material 18. The sole plate then travels across the lower surface of the abrasive material 18 and finally is wiped clean by the absorbent cloth 22. It is noted that the abrasive material 18 is woven in such a fashion that it is more abrasive in the direction A.

Most modern irons have a maximum temperature setting of approximately 420°–425° F. The materials used for the abrasive surface have melting points about the iron's maximum temperature. Accordingly, the article 10 can be used when the iron is either hot or cold.

Figure 4:
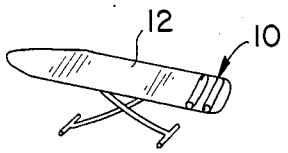
FIG. 4 is an isometric view of an ironing board including an ironing board cover having the preferred embodiment of the present invention affixed thereto.
Figure 3:
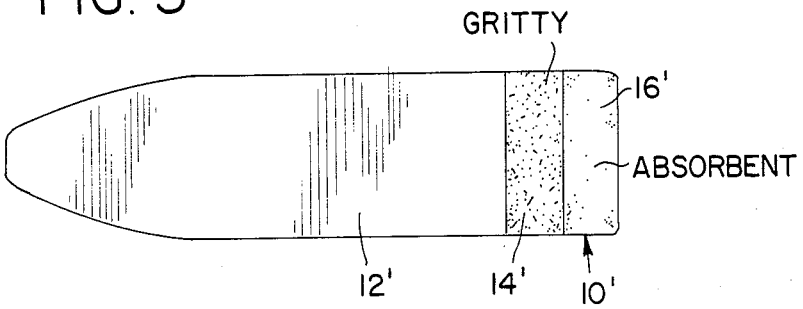
FIG. 3 is a plan view of an ironing board covering having an alternate embodiment of the present invention affixed thereto.

Referring to FIG. 3, there is shown an alternate embodiment 10' of the present invention. The abrasive surface 14' can be any of the materials disclosed above. The abrasive surface 14' is a flat strip which is affixed in any conventional manner across the ironing board cover 12. The absorbent surface 16', made of any material disclosed above, is juxtaposed to the abrasive surface 14'. The absorbent surface 16' is a flat strip which is affixed to the ironing board cover in any conventional manner.

The present invention may be embodied in other specific forms without departing from the spirit or essential attributes thereof and, accordingly, reference should be made to the appended claims, rather than to the foregoing specification, as indicating the scope of the invention.

I claim:

1. An iron sole plate cleaning article in combination with an ironing board cover, said article comprises:

abrasive strip layer means which is affixed to the ironing board cover; and absorbent strip layer means which is affixed to the ironing board cover and is juxtaposed to said abrasive strip layer means.

2. The article according to claim 1 wherein said abrasive strip layer means is a woven material.

3. The article according to claim 1 wherein said abrasive strip layer means includes a knitted fabric of extruded monofilament nylon 66 fiber.

4. The article according to claim 1 wherein said absorbent strip layer means includes a cotton containing fabric.

5. The article according to claim 1 further comprising said absorbent strip layer means which may be chemically treated.

6. An iron sole plate cleaning article in combination with an ironing board cover, the article comprises:

abrasive strip layer means being affixed to the ironing board cover, said abrasive strip layer means having a raised portion and a lower portion; and absorbent strip layer means which is affixed to said abrasive strip layer means and is juxtaposed to said lower portion.

7. The article according to claim 6 wherein said absorbent strip layer means is raised above said lower portion.

8. The article according to claim 7 wherein said raised absorbent strip layer means is formed by a cord.

9. The article according to claim 6 wherein said raised portion of said abrasive strip layer means is formed by a cord.

10. The article according to claim 6 wherein said abrasive strip layer means is a woven material.

11. The article according to claim 6 wherein said abrasive strip layer means includes a knitted fabric of extruded monofilament nylon 66 fiber.

12. The article according to claim 6 wherein said absorbent strip layer means includes a cotton containing fabric.

13. The article according to claim 6 further comprises said absorbent strip layer means which may be chemically treated.

* * * * *